US008019262B2

(12) United States Patent
Sato et al.

(10) Patent No.: US 8,019,262 B2
(45) Date of Patent: Sep. 13, 2011

(54) BELT TRANSPORTING APPARATUS, IMAGE FORMING APPARATUS AND BELT MEMBER TRANSPORTING METHOD WITH OBILQUENESS MITIGATION

(75) Inventors: Masahiro Sato, Ebina (JP); Shuichi Nishide, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 807 days.

(21) Appl. No.: 12/030,518

(22) Filed: Feb. 13, 2008

(65) Prior Publication Data

US 2009/0035031 A1 Feb. 5, 2009

(30) Foreign Application Priority Data

Aug. 1, 2007 (JP) ..... 2007-200594

(51) Int. Cl.
*G03G 15/01* (2006.01)

(52) U.S. Cl. ..... 399/302

(58) Field of Classification Search ..... 399/298, 399/299, 302

See application file for complete search history.

(56) References Cited

U.S. PATENT DOCUMENTS

| | | | | |
|---|---|---|---|---|
| 7,587,158 | B2 * | 9/2009 | Pargett et al. | 399/302 |
| 7,668,491 | B2 * | 2/2010 | Furuya et al. | 399/302 |
| 2003/0219288 | A1 | 11/2003 | Hagiwara et al. | 399/299 |

FOREIGN PATENT DOCUMENTS

| | | | |
|---|---|---|---|
| CN | 1459676 | A | 12/2003 |
| JP | 2003-076149 | | 3/2003 |
| JP | 2004-347697 | | 12/2004 |
| JP | 2006-053492 | | 2/2006 |
| JP | 2006-154879 | A | 6/2006 |

* cited by examiner

*Primary Examiner* — William J Royer

(74) *Attorney, Agent, or Firm* — Morgan, Lewis & Bockius LLP

(57) ABSTRACT

A belt transporting apparatus is provided with a belt member that is rotated; a first roll member that holds the belt member; a second roll member that is provided apart from the first roll member by a first distance, holds the belt member together with the first roll member and is movable toward the first roll member; and a third roll member that is provided apart from the second roll member by a second distance and holds the belt member together with the second roll member. The second distance is longer than the first distance.

8 Claims, 7 Drawing Sheets

FIG.4

| SAMPLE | PATTERN OF EXPERIMENAL MACHINE 100 | ROTATING DIRECTION OF BELT 121 | MISALIGNMENT DIRECTION | CONDITIONS OF OBLIQUE ROLL 123 | | | | OBLIQUE AMOUNT |
|---|---|---|---|---|---|---|---|---|
| | | | | OBLIQUE DIRECTION | OBLIQUE OBJECT FACE | OBLIQUE OBJECT ROLL | OBLIQUE ROLL POSITION | |
| S1 | A | CLOCKWISE | X DIRECTION | NON-BELT FACE | — | — | DOWNSTREAM | ◎ |
| S2 | | | Z DIRECTION | BELT FACE | SHORT BELT | DRIVE ROLL | DOWNSTREAM | ○ |
| S3 | B | | X DIRECTION | NON-BELT FACE | — | — | DOWNSTREAM | × |
| S4 | | | Z DIRECTION | BELT FACE | SHORT BELT | FIXED ROLL | DOWNSTREAM | ◎ |
| S5 | C | COUNTER-CLOCKWISE | X DIRECTION | NON-BELT FACE | — | — | UPSTREAM | × |
| S6 | | | Z DIRECTION | BELT FACE | SHORT BELT | DRIVE ROLL | UPSTREAM | ◎ |
| S7 | D | | X DIRECTION | NON-BELT FACE | — | — | UPSTREAM | ○ |
| S8 | | | Z DIRECTION | BELT FACE | SHORT BELT | FIXED ROLL | UPSTREAM | ○ |
| S9 | E | CLOCKWISE | X DIRECTION | BELT FACE | SHORT BELT | DRIVE ROLL | UPSTREAM | ◎ |
| S10 | | | Z DIRECTION | NON-BELT FACE | — | — | UPSTREAM | ○ |
| S11 | F | | X DIRECTION | BELT FACE | LONG FACE | DRIVE ROLL | UPSTREAM | ○ |
| S12 | | | Z DIRECTION | BELT FACE | SHORT BELT | FIXED ROLL | UPSTREAM | ○ |
| S13 | G | COUNTER-CLOCKWISE | X DIRECTION | BELT FACE | SHORT BELT | DRIVE ROLL | DOWNSTREAM | ○ |
| S14 | | | Z DIRECTION | NON-BELT FACE | — | — | DOWNSTREAM | ○ |
| S15 | H | | X DIRECTION | BELT FACE | LONG FACE | DRIVE ROLL | DOWNSTREAM | × |
| S16 | | | Z DIRECTION | BELT FACE | SHORT BELT | FIXED ROLL | DOWNSTREAM | ◎ |

| | OBLIQUE DIRECTION | CORRESPONDING SAMPLES |
|---|---|---|
| GA1 | BELT FACE | S2, S4, S6, S8, S9, S11, S12, S13, S15, S16 |
| GA2 | NON-BELT FACE | S1, S3, S5, S7, S10, S14 |
FIG.5A
| | OBLIQUE DIRECTION | OBLIQUE OBJECT FACE | CORRESPONDING SAMPLES |
|---|---|---|---|
| GB1 | BELT FACE | SHORT FACE | S2, S4, S6, S8, S9, S12, S13, S16 |
| GB2 | | LONG FACE | S11, S15 |
FIG.5B
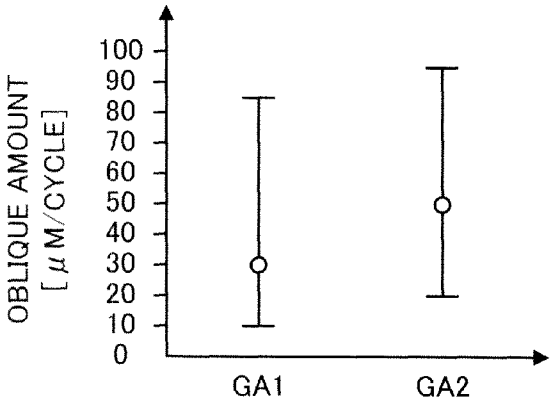
FIG.5C
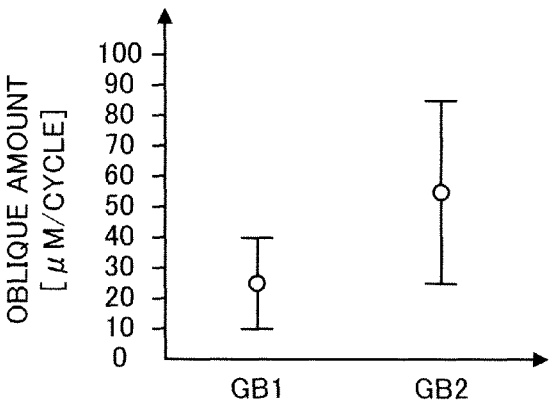
FIG.5D FIG.6A
| | OBLIQUE DIRECTION | OBLIQUE OBJECT FACE | OBLIQUE OBJECT ROLL | CORRESPONDING SAMPLES |
|---|---|---|---|---|
| GC1 | BELT FACE | SHORT FACE | DRIVE ROLL | S2, S6, S9, S13 |
| GC2 | | | FIXED ROLL | S4, S8, S12, S16 |
FIG.6B
| | OBLIQUE DIRECTION | OBLIQUE OBJECT FACE | OBLIQUE OBJECT ROLL | OBLIQUE POSITION | CORRESPONDING SAMPLES |
|---|---|---|---|---|---|
| GD1 | BELT FACE | SHORT FACE | DRIVE ROLL | UPSTREAM | S6, S9 |
| GD2 | | | | DOWNSTREAM | S2, S13 |
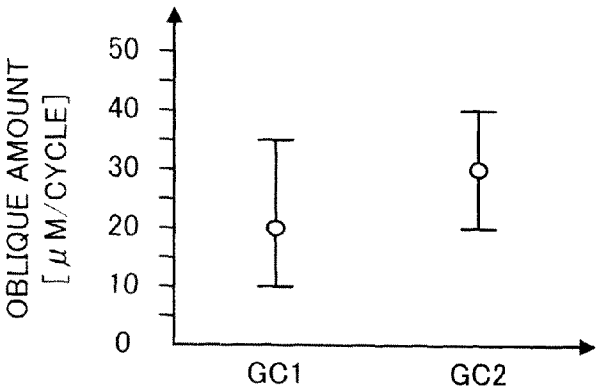
FIG.6C
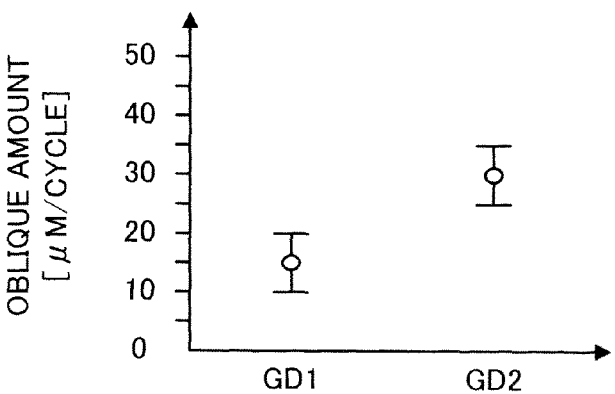
FIG.6D

BELT TRANSPORTING APPARATUS, IMAGE FORMING APPARATUS AND BELT MEMBER TRANSPORTING METHOD WITH OBILQUENESS MITIGATION

CROSS REFERENCE TO RELATED APPLICATIONS

This application is based on and claims priority under 35 USC §119 from Japanese Patent Application No. 2007-200594 filed Aug. 1, 2007.

BACKGROUND

1. Technical Field

The present invention relates to a belt transporting apparatus, an image forming apparatus and a belt member transporting method.

2. Related Art

When a roll member that holds a belt member is moved relative to the belt member, there is a case where the moved roll member is not arranged in the originally intended position and is slightly oblique to a belt face of the belt member, for example. Then, once the roll member brings such obliquity, the belt member which is wrapped over the roll member tends to move in an axis direction of the roll member, and this will cause the so-called obliqueness in the belt member.

The present invention is directed to suppress the obliqueness arising in the belt member when the roll member that holds the belt member is moved.

SUMMARY

According to an aspect of the invention, there is provided a belt transporting apparatus including: a belt member that is rotated; a first roll member that holds the belt member; a second roll member that is provided apart from the first roll member by a first distance, holds the belt member together with the first roll member and is movable toward the first roll member; and a third roll member that is provided apart from the second roll member by a second distance and holds the belt member together with the second roll member. The second distance is longer than the first distance.

BRIEF DESCRIPTION OF THE DRAWINGS

Exemplary embodiment(s) of the present invention will be described in detail based on the following figures, wherein:

FIG. 4 is a table which collects conditions of an experimental machine and evaluations of the oblique amount for each sample;

FIGS. 5A to 5D and 6A to 6D are charts that illustrate grouping of samples and differences in oblique amount for each group.

DETAILED DESCRIPTION

Exemplary embodiments of the present invention will be described in detail below with reference to the accompanying drawings.

First Exemplary Embodiment

Figure 1:
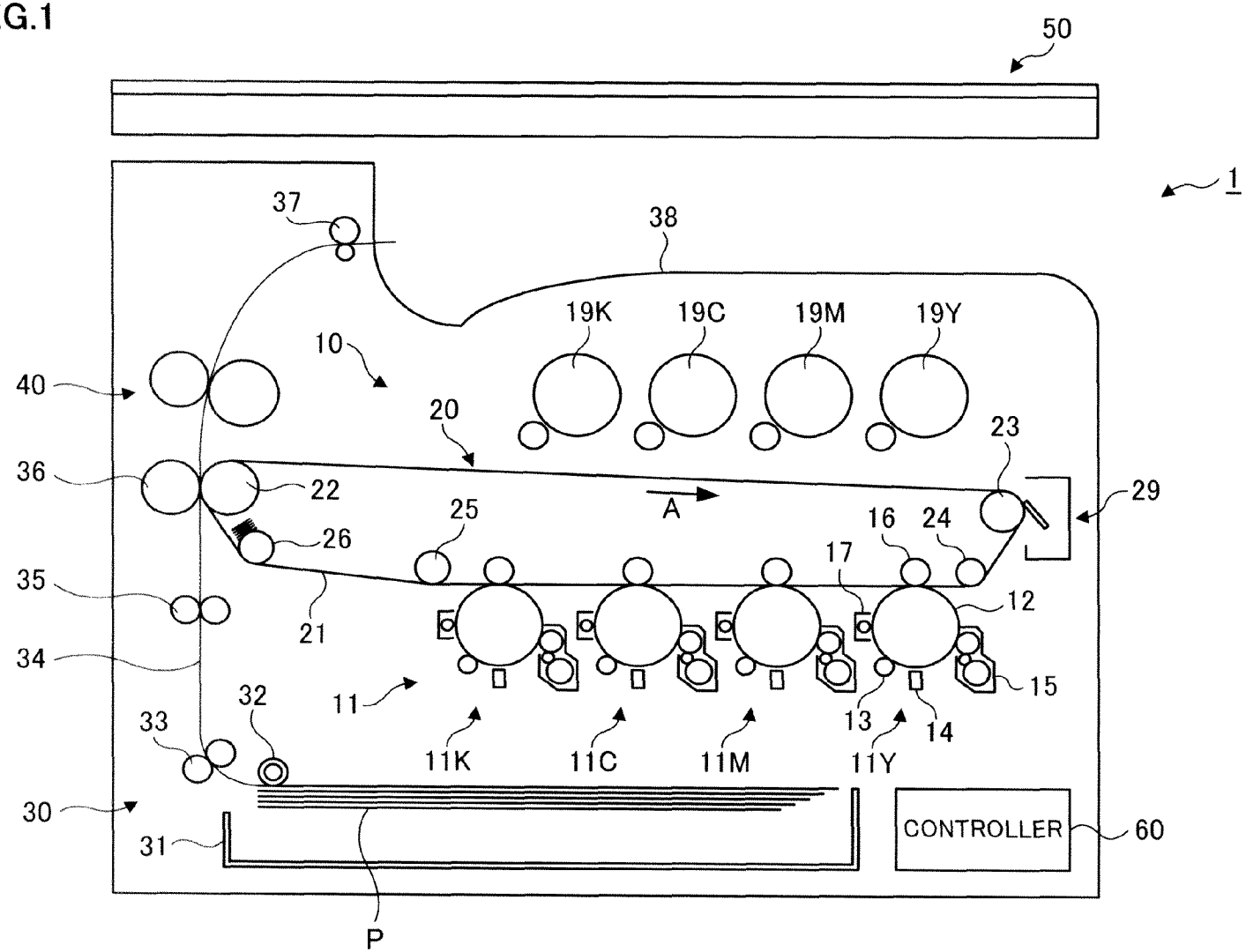
FIG. 1 is a diagram that illustrates the entire configuration of an image forming apparatus according to a first exemplary embodiment.

FIG. 1 is a diagram that illustrates the entire configuration of an image forming apparatus 1 according to a first exemplary embodiment.

The image forming apparatus 1 is provided with an image processing system 10, a sheet transportation system 30, a scanner unit 50, and a controller 60. The image processing system 10 includes image forming units 11 (11Y, 11M, 11C and 11K) as an image forming unit which forms a full-color image of four colors of yellow (Y), magenta (M), cyan (C), and black (K), and a transfer unit 20.

Respective image forming units 11 (11Y, 11M, 11C, 11K) are arranged in a horizontal direction at a fixed interval in parallel, and form predetermined respective color toner images. Further, the transfer unit 20 transports the toner images toward a secondary transfer position in which the respective color toner images formed by the image forming units 11 are subjected to multiple transfer, and then transferred to a sheet P. It should be noted that these image forming units 11 and transfer unit 20 will be described in detail later.

The sheet transportation system 30 includes a transportation path 34 that transports the sheet P from a sheet storage portion 31 stacking the sheet P as a recording medium to a discharged sheet stack portion 38 stacking the sheet P after the toner image is fixed. On the transportation path 34, there are provided a delivery roll 32, a handling roll 33, a resist roll 35, a secondary transfer roll 36, and an exit roll 37. Between the secondary transfer roll 36 and the exit roll 37 on the transportation path 34, there are provided a fixing unit 40 that fixes the toner image on the sheet P using heat and pressure, to the sheet P to which the toner image has been secondarily transferred.

The delivery roll 32 picks up the sheets P from the sheet storage portion 31 to feed them toward the transportation path 34. Further, the handling roll 33 separates sheets P fed from the delivery roll 32 into each one sheet P and transports the sheet P. The resist roll 35 transports the sheet P toward the secondary transfer position at a right time. The secondary transfer roll 36 that functions as one example of a transfer member is opposed to a backup roll 22 which will be described later, and secondarily transfers a multiple toner image on the sheet P. The exit roll 37 discharges the sheet P after the toner image is fixed outside the image forming apparatus 1.

The scanner unit 50 reads an image of an original placed or transported on a platen glass by a CCD image sensor (not shown in the figure) or the like.

The controller 60 provides an image processing for an image data received from the scanner unit 50 or, for example, an image data received from a personal computer (PC) or the like. Further, the controller 60 also controls each portion of the above-described image processing system 10 and the sheet transportation system 30.

Note that the image forming apparatus 1 is provided with toner cartridges 19Y, 19M, 19C and 19K to supply respective color toners to the image forming units 11.

Next, with respect to the image forming units 11 (11Y, 11M, 11C and 11K), the yellow image forming unit 11Y will be described as a representative example. Note that other image forming units 11M, 11C and 11K have substantially a similar configuration to the yellow image forming unit 11Y excepting the toner which is stored in a developing unit 15.

The image forming unit 11Y includes a photosensitive drum 12 that functions as an image carrier that holds the toner image. Further, the image forming unit 11Y is provided with a charging unit 13, an exposure unit 14, the developing unit 15, a primary transfer roll 16 that functions as a primary transfer member, and a drum cleaner 17, which are arranged on the circumference of the photosensitive drum 12.

The charging unit 13 charges the photosensitive drum 12 using a charging roll. The exposure unit 14 irradiates the photosensitive drum 12 charged by the charging unit 13 with light to form an electrostatic latent image on the photosensitive drum 12. Further, the developing unit 15 develops with toner the electrostatic latent image formed on the photosensitive drum 12 by the charging unit 13. The primary transfer roll 16 is arranged to be opposed to the photosensitive drum 12 while an intermediate transfer belt 21 described later is sandwiched therebetween. The primary transfer roll 16 transfers the toner image developed on the photosensitive drum 12 on the intermediate transfer belt 21. Furthermore, the drum cleaner 17 removes the toner that is remained on the photosensitive drum 12 after the transfer.

Figure 2:
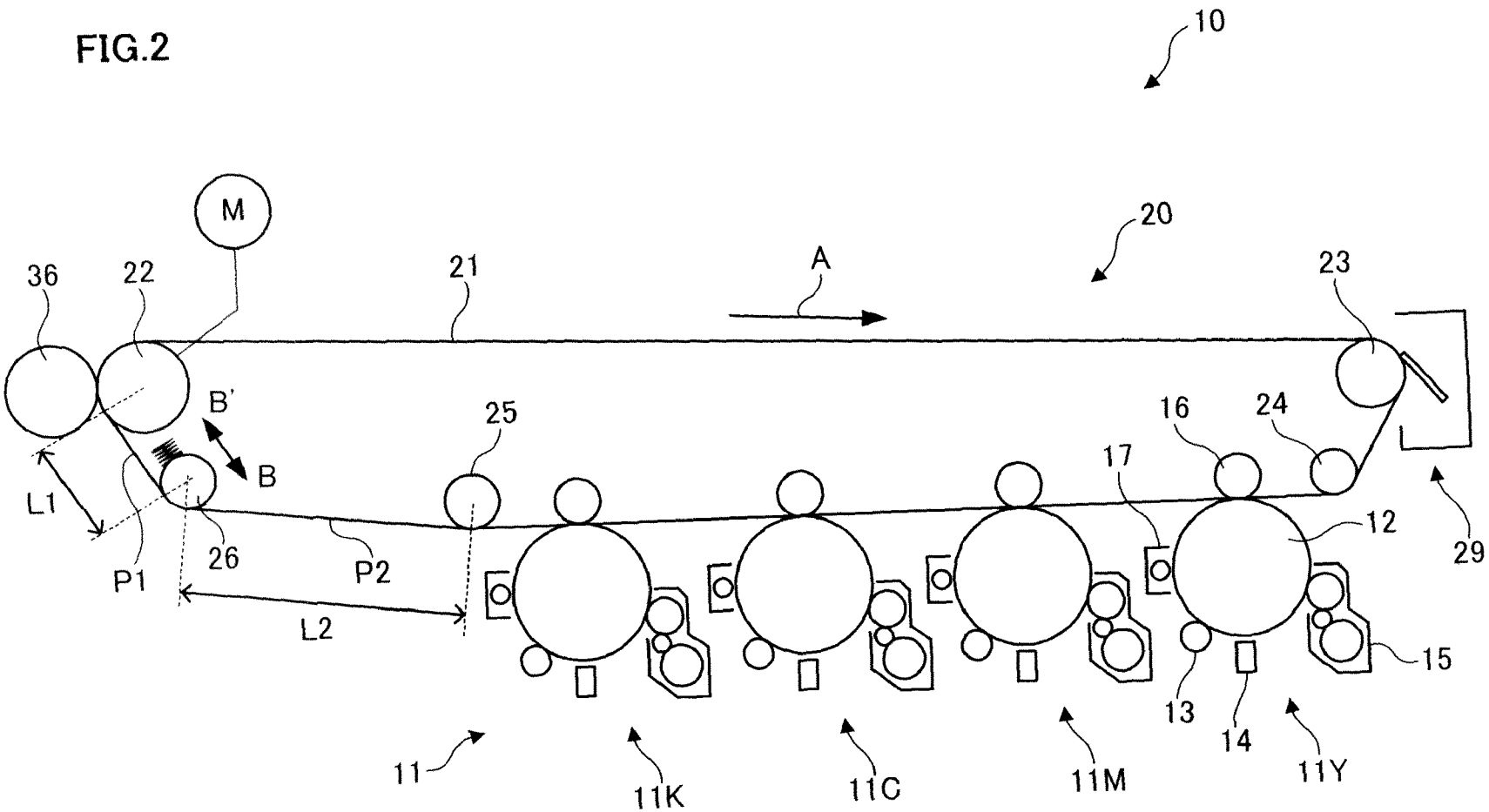
FIG. 2 is a diagram that illustrates a tension roll in a transfer unit.

The transfer unit 20 as one of the belt transporting apparatus includes the intermediate transfer belt 21, various kinds of rolls, a belt cleaner 29, and a driving motor M (refer to FIG. 2).

The intermediate transfer belt 21 as one example of a belt member is wrapped over the backup roll 22 that functions as a first roll member and a drive roll, a cleaner opposed roll 23, a primary transfer upstream side roll 24, a primary transfer downstream side roll 25 as a third roll member, and a tension roll 26 that functions as a second roll member and a tension-adjusting roll under a fixed tension (tensile force). The driving motor M is connected to the backup roll 22. The intermediate transfer belt 21 obtains driving force from the backup roll 22, and is rotated in an arrow direction A (clockwise) in FIG. 1.

The backup roll 22 is arranged so as to be opposed to the secondary transfer roll 36, and forms the secondary transfer position where the multiple toner images on the intermediate transfer belt 21 are transferred to the sheet P. As a material of the surface of the backup roll 22, rubber or the like having a high coefficient of friction and a elasticity is used.

The cleaner opposed roll 23 is arranged on the downstream side in a rotating direction of the intermediate transfer belt 21 relative to the backup roll 22. Further, the cleaner opposed roll 23 is opposed to the belt cleaner 29 and forms a cleaning position on the intermediate transfer belt 21. The belt cleaner 29 functions as one example of a cleaning member that brings, for example, its blade or the like in contact with the surface of the intermediate transfer belt 21 to remove the toner or the like that is remained on the intermediate transfer belt 21.

The primary transfer upstream side roll 24 is arranged on the downstream side in the rotating direction of the intermediate transfer belt 21 relative to the cleaner opposed roll 23. The primary transfer downstream side roll 25 is arranged on the downstream side in the rotating direction of the intermediate transfer belt 21 relative to the primary transfer upstream side roll 24. These primary transfer upstream side roll 24 and primary transfer downstream side roll 25 are arranged so that four primary transfer rolls 16 provided on the respective image forming units 11 are put therebetween. Further, the primary transfer upstream side roll 24 is attached on the upstream side relative to a yellow (Y) primary transfer roll 16, and the primary transfer downstream side roll 25 is attached on the downstream side relative to a black (K) primary transfer roll 16. Furthermore, a primary transfer face with the image forming units 11 is formed on the intermediate transfer belt 21 by these primary transfer upstream side roll 24 and primary transfer downstream side roll 25.

It should be noted that the position of the rotation axes of the backup roll 22, cleaner opposed roll 23, primary transfer upstream side roll 24 and primary transfer downstream side roll 25 is relatively fixed to the intermediate transfer belt 21.

The tension roll 26 is arranged between the primary transfer downstream side roll 25 and the backup roll 22, that is, on the downstream side in the rotating direction of the intermediate transfer belt 21 relative to the primary transfer downstream side roll 25 and on the upstream side in the rotating direction of the intermediate transfer belt 21 relative to the backup roll 22. Unlike the above-described backup roll 22, cleaner opposed roll 23, primary transfer upstream side roll 24, and primary transfer downstream side roll 25, the tension roll 26 is relatively movably attached to the intermediate transfer belt 21. Further, the tension roll 26 is pressed against the intermediate transfer belt 21 by an elastic member such as a spring. This causes the tension roll 26 to provide the intermediate transfer belt 21 with fixed tension to lessen slack in the intermediate transfer belt 21. Note that the details of an attachment position of the tension roll 26, setting of its direction of movement or the like will be described later.

It should be noted that the above-described respective primary transfer rolls 16 are brought into contact with the intermediate transfer belt 21. However, the primary transfer rolls 16 are not configured so as to press against the intermediate transfer belt 21 as compared with rolls over which a belt is wrapped such as, for example, the backup roll 22, the cleaner opposed roll 23, the primary transfer upstream side roll 24, and the primary transfer downstream side roll 25.

Next, an image forming operation of the image forming apparatus 1 will be described.

The image data on an original read by, for example, the scanner unit 50, or the image data obtained from a PC or the like (not shown in the figure) are transmitted to the controller 60 as, for example, reflectance data of each 8 bits of R (red), G (green), and B (blue). In the controller 60, the inputted reflectance data is subjected to a certain image processing such as shading correction, displacement correction, brightness/color-space conversion, gamma correction, border erasing, color editing, various kind of image editing such as editing by moving and the like. The image data having been subjected to the image processing are converted into color material gradation data of four colors of yellow (Y), magenta (M), cyan (C) and black (K). The data thus converted is then outputted to the respective exposure units 14 of the image forming units 11.

In the image forming units 11, respective photosensitive drums 12 are charged at a predetermined electric potential by the respective charging units 13. Further, in the image forming units 11, the exposure units 14 irradiate the photosensitive drums 12 with light in response to a color material gradation data inputted from the controller 60. In the respective photosensitive drums 12 of the image forming units 11, the charged surfaces are exposed and electrostatic latent images are formed. The formed electrostatic latent images are developed as respective color toner images of yellow (Y), magenta (M), cyan (C), and black (K) by the respective developing units 15 of the image forming units 11.

The toner image formed on respective photosensitive drums 12 of the image forming units 11 are subjected to multiple transfers in turn on the intermediate transfer belt 21 using the respective primary transfer rolls 16. Further, the photosensitive drums 12 of the image forming units 11 after transfer are cleaned by the drum cleaner 17.

On the other hand, in the sheet transportation system 30, the delivery roll 32 removes the sheets P from the sheet storage portion 31 at the timing of image formation. Then, the sheet P, which is separated into each one sheet by the handling roll 33, is transported to the resist roll 35 via the transportation path 34, and then temporarily stopped. Thereafter, the resist roll 35 is rotated at the timing of a movement of the intermediate transfer belt 21 on which the toner image is formed, and the sheet P is transported to the secondary transfer position which is formed by the backup roll 22 and the secondary transfer roll 36. On the sheet P transported from the bottom to the top in the secondary transfer position, a four-color overlapped toner image is transferred in a transportation direction of the intermediate transfer belt 21 in turn using pressure and a predetermined electric field. Then, the sheet P to which respective color toner images are transferred is subjected to fixing processing using heat and pressure by the fixing unit 40, and then by the exit roll 37, it is discharged to the discharged sheet stack portion 38 provided on the upper portion of the image forming apparatus 1. Meanwhile, the intermediate transfer belt 21 after secondary transfer is cleaned by the belt cleaner 29 to prepare for a next process.

FIG. 2 is a diagram that illustrates the tension roll 26 in the transfer unit 20. In addition, FIG. 2 shows the driving motor M that drives the backup roll 22.

Next, referring to FIG. 2, an attachment position of the tension roll 26, setting of its moving direction and the like which are determined based on findings obtained from experiments performed in advance (described later) will be described.

In this example, on the intermediate transfer belt 21, a first face P1 is formed by the tension roll 26 and the backup roll 22, and a second face P2 is formed by the tension roll 26 and the primary transfer downstream side roll 25. Here, a first distance L1 that is a length of the first face P1 in the rotating direction is set shorter than a second distance L2 that is a length of the second face P2 in the rotating direction.

Further, the tension roll 26 is arranged to be slidable along the first face P1 formed on the intermediate transfer belt 21. An elastic member presses the tension roll 26 against the side leaving from the backup roll 22. This causes the tension roll 26 to be moved in a direction B leaving from the backup roll 22 along the first face P1 when tension applied to the intermediate transfer belt 21 is decreased, for example. On the other hand, for example, when tension applied to the intermediate transfer belt 21 is increased, the tension roll 26 is moved in a direction B' approaching to the backup roll 22 along the first face P1.

As stated above, the tension roll 26 in the first exemplary embodiment is to be arranged so as to satisfy the following conditions:

(1) The tension roll 26 is arranged so as to be moved along a face (the first face P1 or the second face P2, and in this example, the first face P1) formed on the intermediate transfer belt 21 by the tension roll 26 or the like.

(2) The tension roll 26 is arranged so as to be moved along the first face P1 having a shorter length in the rotating direction (L1<L2), between the first face P1 and the second face P2 formed on the intermediate transfer belt 21 by the tension roll 26 or the like.

(3) The tension roll 26 is arranged so as to approach to or leave from the backup roll 22 driven by the driving motor M, between the primary transfer downstream side roll 25 and the backup roll 22 which are arranged to be adjacent to the tension roll 26.

(4) The tension roll 26 is arranged on the upstream side of the backup roll 22 driven by the driving motor M in the rotating direction of the intermediate transfer belt 21.

Next, an experiment which is a basis to determine an attachment position of the tension roll 26, setting of its direction of movement and the like in the transfer unit 20 as described above will be described.

The purpose of the present experiment is to elucidate characteristics of belt obliqueness due to differences in condition of apparatus (positional relation between respective rolls, the rotating direction of the belt or the like) in the case of so-called misalignment when a roll attached to be movable relative to the intermediate transfer belt 21 (belt) such as the tension roll 26 has an angle different from an originally intended angle relative to the belt.

FIGS. 3A to 3H are diagrams that illustrate patterns of an experimental machine 100.

As shown in FIG. 3, the experimental machine 100 used in the present experiment is configured by a belt 121, a drive roll 122, an oblique roll 123, and a fixed roll 124. Further, the belt 121 is wrapped over these three rolls and has a so-called right-angled triangle shape.

Note that in the experimental machine 100, the belt 121 corresponds to the intermediate transfer belt 21, the drive roll 122 corresponds to the backup roll 22, the oblique roll 123 corresponds to the tension roll 26, and the fixed roll 124 corresponds to the primary transfer downstream side roll 25 respectively.

The drive roll 122 applies a rotation drive to the belt 121. Further, a rubber having a high coefficient of friction and a specific elasticity are used for the surface of the drive roll 122, similarly to the corresponding backup roll 22.

The oblique roll 123 simulates a state where misalignment occurs as a result of movement of a movable roll such as the tension roll 26 in the first exemplary embodiment. Accordingly, the oblique roll 123 is configured so as to be intentionally misaligned by inserting a shim (a metal plate) into the bearing portion thereof. Further, misalignment directions of the oblique roll 123 are set in two directions of a horizontal direction (hereinafter, referred to as an X direction) and a vertical direction (hereinafter, referred to as a Z direction). Note that the misalignment directions of the oblique roll 123 correspond to moving directions of the tension roll 26.

Among faces of the belt 121 formed by the oblique roll 123 and the adjacent rolls (the drive roll 122 or the fixed roll 124), one which is short in distance in a rotating direction of the belt 121 is referred to as a short side SS and the other which is long in distance is referred to as a long side LS. Further, with respect to the faces of the belt 121 at this time, a face corresponding to the short side SS is referred to as a short face SP and a face corresponding to the long side LS is referred to as a long face LP.

As shown in FIGS. 3A to 3H, eight types of the experimental machines 100 (patterns A to H) are prepared in which arrangements of the drive roll 122, the oblique roll 123 and the fixed roll 124, or rotating directions of the belt 121 are changed. Further, in respective patterns, two directions (X direction and Z direction) in the misalignment direction of the oblique roll 123 are experimented to obtain a measurement result of an oblique amount of the belt 121 in a total of 16 samples. Note that the oblique amount of the belt 121 (hereinafter, referred to as an oblique amount) refers to the amount of deviations in a direction orthogonal to the rotating direction of the belt 121 per rotation of the belt 121. Further, its unit is represented by "μm/cycle".

Next, the details of the experimental machine 100 in respective patterns will be described in order of patterns A to H.

Figure 3A:
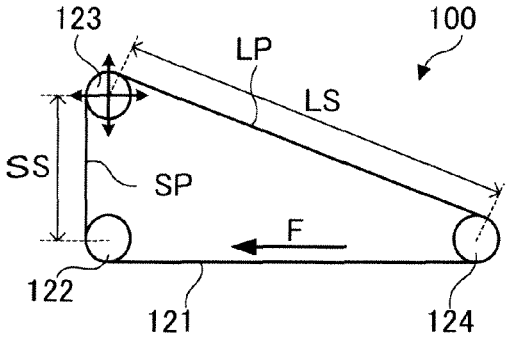
FIGS. 3A to 3H are diagrams that illustrate patterns of an experimental machine.

In the pattern A shown in FIG. 3A, the drive roll 122 is arranged on the left bottom side in the figure, the oblique roll 123 is arranged on the vertical top side of the drive roll 122, and further the fixed roll 124 is arranged on the right side in the figure in a horizontal direction of the drive roll 122. The rotating direction of the belt 121 is made clockwise (in direction of arrow F in FIG. 3A). Thus, the drive roll 122 is positioned on the upstream side in the rotating direction of the belt 121, and the fixed roll 124 is positioned on the downstream side in the rotating direction of the belt 121, relative to the oblique roll 123. Further, the short face SP of the belt 121 is formed by the oblique roll 123 and the drive roll 122, and the long face LP is formed by the oblique roll 123 and the fixed roll 124. Note that, in the following description, the case where the misalignment direction of the oblique roll 123 in the pattern A is the X direction is designated as a sample S1, and the case where the misalignment direction is the Z direction is designated as a sample S2 (referred to FIG. 4).

Figure 3E:
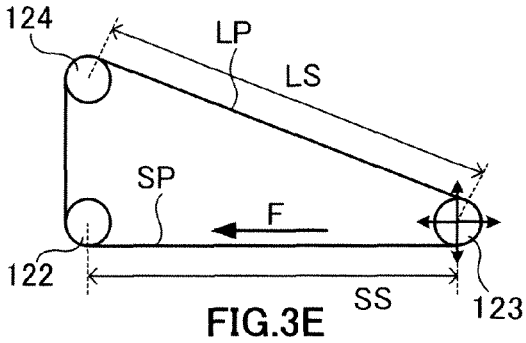
Figure 3B:
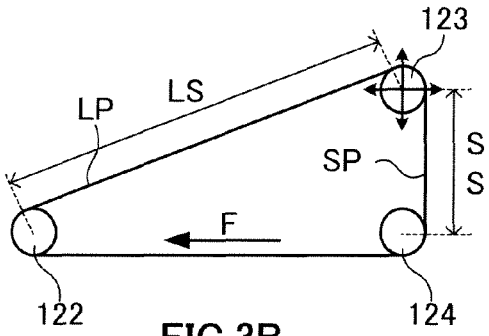

The pattern B shown in FIG. 3B differs in that the oblique roll 123 is positioned on the vertical top side of the fixed roll 124, as compared with the pattern A. Thus, the short face SP of the belt 121 is formed by the oblique roll 123 and the fixed roll 124, and the long face LP is formed by the oblique roll 123 and the drive roll 122. In addition, the rotating direction of the belt 121, and the relation between the upstream and the downstream positions among the respective rolls in the rotating direction of the belt 121 are similar to the pattern A. Note that in the following description, the case where the misalignment direction of the oblique roll 123 in the pattern B is the X direction is designated as a sample S3, and the case where the misalignment direction is the Z direction is designated as a sample S4.

Figure 3F:
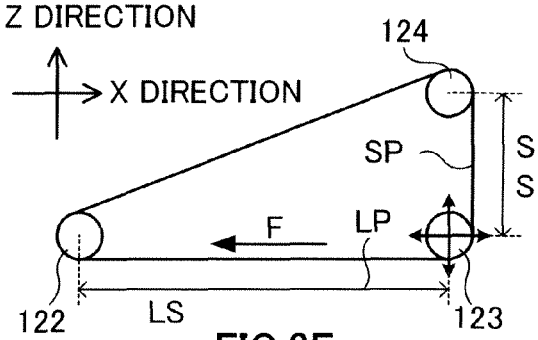
Figure 3C:
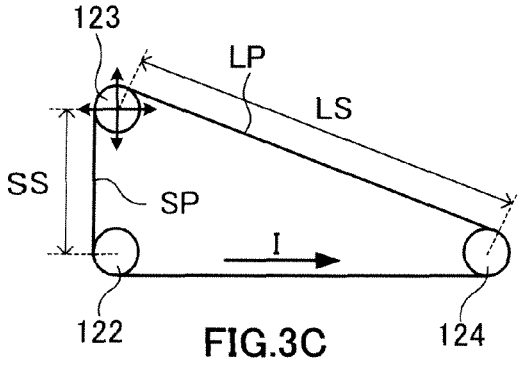

In the pattern C shown in FIG. 3C, an arrangement of the respective rolls is made similar to the pattern A, and the rotating direction of the belt 121 is changed counterclockwise (a direction of arrow I in FIG. 3C). Thus, in the pattern C, the fixed roll 124 is positioned on the upstream side in the rotating direction of the belt 121 and the drive roll 122 is positioned on the downstream side in the rotating direction of the belt 121, relative to the oblique roll 123. Note that the relation between the short face SP and the long face LP is similar to the pattern A. Further, in the following description, the case where the misalignment direction of the oblique roll 123 in the pattern C is the X direction is designated as a sample S5, and the case where the misalignment direction is the Z direction is designated as a sample S6.

Figure 3G:
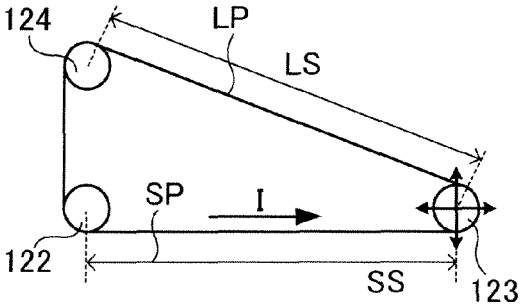
Figure 3D:
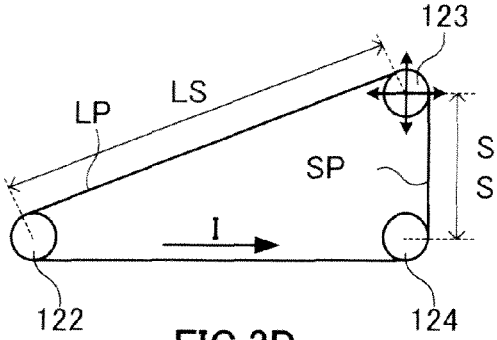

In the pattern D shown in FIG. 3D, an arrangement of the respective rolls is made similar to the pattern B, and the rotating direction of the belt 121 is changed counterclockwise (a direction of arrow I in FIG. 3D). Thus, in the pattern D, the fixed roll 124 is positioned on the upstream side in the rotating direction of the belt 121 and the drive roll 122 is positioned on the downstream side in the rotating direction of the belt 121, relative to the oblique roll 123. In addition, the relation between the short face SP and the long face LP is similar to the pattern B. Further, in the following description, the case where the misalignment direction of the oblique roll 123 in the pattern D is the X direction is designated as a sample S7, and the case where the misalignment direction is the Z direction is designated as a sample S8.

In the pattern E shown in FIG. 3E, the arrangements of the oblique roll 123 with the fixed roll 124 in the pattern A are replaced with each other. In other words, the drive roll 122 is arranged on the left bottom side in the figure, the fixed roll 124 is arranged on the vertical top side of the drive roll 122, and the oblique roll 123 is arranged on the right side in the figure in a horizontal direction of the drive roll 122. Thus, the fixed roll 124 is positioned on the upstream side in the rotating direction of the belt 121 and the drive roll 122 is positioned on the downstream side in the rotating direction of the belt 121, relative to the oblique roll 123. Further, the short face SP of the belt 121 is formed by the oblique roll 123 and the drive roll 122, and the long face LP is formed by the oblique roll 123 and the fixed roll 124. Note that in the following description, the case where the misalignment direction of the oblique roll 123 in the pattern E is the X direction is designated as a sample S9, and the case where the misalignment direction is the Z direction is designated as a sample S10.

The pattern F shown in FIG. 3F differs in that the fixed roll 124 is positioned on the vertical top side of the oblique roll 123, as compared with the above-described pattern E. Thus, the short face SP of the belt 121 is formed by the oblique roll 123 and the fixed roll 124, and the long face LP is formed by the oblique roll 123 and the drive roll 122. In addition, the rotating direction of the belt 121, and the relation between the upstream and the downstream positions among the respective rolls in the rotating direction of the belt 121 are similar to the pattern E. Note that, in the following description, the case where the misalignment direction of the oblique roll 123 in the pattern F is the X direction is designated as a sample S11, and the case where the misalignment direction is the Z direction is designated as a sample S12.

In the pattern G shown in FIG. 3G, an arrangement of the respective rolls is made similar to the pattern E, and the rotating direction of the belt 121 is changed counterclockwise (a direction of arrow I in FIG. 3G). Thus, in the pattern G, the drive roll 122 is positioned on the upstream side in the rotating direction of the belt 121 and the fixed roll 124 is positioned on the downstream side in the rotating direction of the belt 121, relative to the oblique roll 123. Note that the relation between the short face SP and the long face LP is similar to the pattern A. Further, the case where the misalignment direction of the oblique roll 123 in the pattern G is the X direction is designated as a sample S13, and the case where the misalignment direction is the Z direction is designated as a sample S14.

Figure 3H:
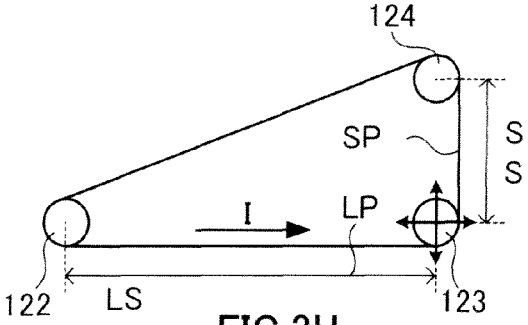

In the pattern H shown in FIG. 3H, an arrangement of the respective rolls is made similar to the pattern F, and the rotating direction of the belt 121 is changed counterclockwise (a direction of arrow I in FIG. 3H). Thus, in the pattern H, the drive roll 122 is positioned on the upstream side in the rotating direction of the belt 121 and the fixed roll 124 is positioned on the downstream side in the rotating direction of the belt 121, relative to the oblique roll 123. Note that the relation between the short face SP and the long face LP is similar to the pattern F. Further, the case where the misalignment direction of the oblique roll 123 in the pattern H is the X direction is designated as a sample S15, and the case where the misalignment direction is the Z direction is designated as a sample S16.

In the experimental machines 100 of the above-described respective patterns, the belt 121 is rotatably driven, and the oblique amount arising in the belt 121 is measured.

Then, the analytical result of the above-described experiment will be described.

FIG. 4 is a table which collects conditions of the experimental machine 100 and evaluations of the oblique amount for each sample. Note that in FIG. 4, conditions of the oblique roll 123 and evaluations of the oblique amount for samples S1 to S16 are collected and shown.

The present inventors focus attention on the following four points concerning conditions of the oblique roll 123 when experimental results are analyzed and classified respective samples.

A first point is the relation between a face formed on the belt 121 and the misalignment direction of the oblique roll 123. Note that in the following description, the relation is referred to as an oblique direction. Further, cases where the misalignment direction of the oblique roll 123 is provided along the short face SP or the long face LP and when it is not provided along the short face SP and the long face LP, are classified into a "belt face" and a "non-belt face", respectively.

A second point is, in the case where the oblique direction is the belt face, whether the face to be the object is the short face SP or the long face LP. Note that in the following description, the relation is referred to as an oblique object face. Further, cases where the misalignment direction of the oblique roll 123 is the short face SP and where it is the long face LP, are classified into the "short face" and the "long face", respectively.

A third point is, in the case where the oblique direction is the belt face, whether the oblique object face (the short face SP or the long face LP) is formed by the drive roll 122 or the fixed roll 124. Note that in the following description, the relation is referred to as an oblique object roll. Further, a case where the oblique object face is formed by the oblique roll 123 and the drive roll 122, and a case where the oblique object face is formed by the oblique roll 123 and the fixed roll 124, are classified into the "drive roll" and the "fixed roll", respectively.

A fourth point is related to a relation between the rotating direction of the belt 121 and positions of the drive roll 122 and the oblique roll 123. Note that in the following description, the relation is referred to as an oblique roll position. Further, a case where the oblique roll 123 is positioned on the upstream side in the rotating direction of the belt 121 relative to the drive roll 122, and a case where the oblique roll 123 is positioned on the downstream side in the rotating direction of the belt 121 relative to the drive roll 122, are classified into "upstream" and "downstream", respectively.

Here, the classification based on the above-described four points will specifically be described taking the samples S1 and S2 in the pattern A as an example.

First, in the sample S1, the misalignment direction of the oblique roll 123 is provided as the X direction. Referring to FIG. 3A, the X direction is a different direction from the short face SP and the long face LP. Accordingly, the oblique direction is provided as the non-belt face. Note that in the sample S1, since the oblique direction is provided as the non-belt face, the oblique object face and the oblique object roll are not specified. Further, with reference to FIG. 3A, it is understood that the oblique roll 123 is arranged on the downstream side in the rotating direction of the belt 121 relative to the drive roll 122. Therefore, the oblique roll position is at the downstream.

On the other hand, in the sample S2, the misalignment direction of the oblique roll 123 is provided as the Z direction. Referring to FIG. 3A, the Z direction is the same direction as the short face SP. Accordingly, the oblique direction is provided as the belt face. The oblique object face is provided as the short face SP. Further, referring to FIG. 3A, together with the oblique roll 123, the drive roll 122 forms the short face SP which is the oblique object face. Therefore, the oblique object roll is provided as the drive roll. Furthermore, referring to FIG. 3A, similarly to the sample S1, the oblique roll 123 is arranged on the downstream side in the rotating direction of the belt 121 relative to the drive roll 122. Therefore, the oblique roll position is at the downstream.

Note that other samples S3 to S16 are similarly classified.

Further, the oblique amount is evaluated on three scales. Not more than 20 is represented by a double circle, more than 20 and not more than 40 are represented by a circle, and more than 40 is represented by a cross. Note that, based on an adjacent dot interval of about 40 μm when, for example, the resolution (in this example, a dot interval of the toner image to be formed on the intermediate transfer belt 21) is set as 600 dpi (dot per inch), the above-described values are set as a target. Further, this is because the adjacent dot interval is about 20 μm when the resolution is set as 1200 dpi.

Next, based on the above-described four points, the respective samples S1 to S16 are classified into groups. The oblique amount is compared for each group to attempt to extract a group with the smallest oblique amount.

FIGS. 5A to 5D and 6A to 6D are charts that illustrate grouping of samples and differences in oblique amount for each group.

First, the samples are classified with respect to the oblique direction to compare oblique amounts thereof.

As shown in FIG. 5A, a group GA1 and a group GA2 are classified with respect to the oblique direction. First, the group GA1 contains samples whose oblique direction is the belt face. Accordingly, the group GA1 corresponds to samples S2, S4, S6, S8, S9, S11, S12, S13, S15 and S16.

On the other hand, the group GA2 contains samples whose oblique direction is the non-belt face. Accordingly, the group GA2 corresponds to samples S1, S3, S5, S7, S10 and S14.

Then, the amount of obliqueness is compared between the group GA1 and the group GA2 shown in FIG. 5C. Note that FIG. 5C is a graph of a minimum value, a maximum value and an average value of the oblique amount of samples classified into respective groups (in the following, results of other groups in FIGS. 5D, 6C and 6D are also similar to FIG. 5C).

First, a minimum value of the oblique amount of the group GA1 is a 10, a maximum value thereof is 85 and an average value thereof is 30. On the other hand, a minimum value of the oblique amount of the group GA2 is 20, a maximum value thereof is 95 and an average value thereof is 50. By a comparison between both groups, it is apparent that the group GA1 is smaller in the minimum, the maximum and the average values of the oblique amount as compared with the group GA2. As a result of this, it is apparent that the oblique amount is smaller in the case when the oblique direction is the belt face, as compared with the case when the oblique direction is the non-belt face.

Accordingly, the image forming apparatus 1 in the first exemplary embodiment is configured so as to move the tension roll 26, which may be misaligned following the movement, along the face (the first face P1 or the second face P2, in this example, it is the first face P1) of the intermediate transfer belt 21 formed by the tension roll 26 or the like.

Next, the above-described group GA1 is further classified based on the oblique object face, and the oblique amounts thereof are compared.

As shown in FIG. 5B, a group GB1 contains samples whose oblique direction is the belt face and whose oblique object face is the short face. Accordingly, the group GB1 corresponds to samples S2, S4, S6, S8, S9, S12, S13 and S16.

On the other hand, a group GB2 contains samples whose oblique direction is the belt face and whose oblique object face is the long face. Accordingly, the group GB2 corresponds to samples S11 and S15.

Then, the comparison result of the oblique amounts of the group GB1 and the group GB2 shown in FIG. 5D will be described.

The minimum value of the oblique amount of the group GB1 is 10, a maximum value thereof is 40 and an average value thereof is 25. On the other hand, the minimum value of the oblique amount of the group GB2 is 25, a maximum value thereof is 85 and an average value thereof is 55. Thus, it is apparent that all of the minimum, the maximum and the average values of the oblique amount of the group GB1 are smaller as compared with those of the group GB2. As a result of this, it is apparent that the oblique amount is smaller in the case when the oblique object face is the short face, as compared with the case when the oblique object face is the long face, among samples classified into the group GA1.

Accordingly, the image forming apparatus 1 in the first exemplary embodiment is configured so as to move the tension roll 26 not along the second face P2 but along the first face P1 formed on the intermediate transfer belt 21.

The above-described group GB1 is further classified based on the oblique object roll to attempt comparison of these oblique amounts.

As shown in FIG. 6A, a group GC1 contains samples whose oblique direction is the belt face, whose oblique object face is the short face, and whose oblique object roll is the drive roll. Accordingly, the group GC1 corresponds to samples S2, S6, S9 and S13.

On the other hand, a group GC2 contains samples whose oblique direction is the belt face, whose oblique object face is the short face and whose oblique object roll is the fixed roll. Accordingly, the group GC2 corresponds to samples S4, S8, S12 and S16.

Then, the comparison result of the oblique amounts of the group GC1 and the group GC2 shown in FIG. 6C will be described.

The minimum value of the oblique amount of the group GC1 is 10, a maximum value thereof is 35 and an average value thereof is 20. On the other hand, the minimum value of the oblique amount of the group GC2 is 20, a maximum value thereof is 40 and an average value thereof is 30. Thus, it is apparent that all of the minimum, the maximum and the average values of the oblique amount of the group GC1 are smaller as compared with those of the group GC2. As a result of this, it is apparent that the oblique amount is smaller in the case when the oblique object roll is the drive roll, as compared with the case when the oblique object roll is the fixed roll, among samples classified into the group GB1.

Accordingly, the image forming apparatus 1 in the first exemplary embodiment is configured so that the tension roll 26 approaches to or leaves from the driven backup roll 22 side.

The above-described group GC1 is furthermore classified based on the oblique roll position to attempt comparison of these oblique amounts.

As shown in FIG. 6B, a group GD1 contains samples whose oblique direction is the belt face, whose oblique object face is the short face, whose oblique object roll is the drive roll, and whose oblique roll position is the upstream side. Accordingly, the group GD1 corresponds to samples S6 and S9.

On the other hand, a group GD2 contains samples whose oblique direction is the belt face, whose oblique object face is the short face, whose oblique object roll is the fixed roll, and whose oblique roll position is the downstream side. Accordingly, the group GD2 corresponds to samples S2 and S13.

Then, the comparison result of the oblique amounts of the group GD1 and the group GD2 shown in FIG. 6D will be described.

The minimum value of the oblique amount of the group GD1 is 10, a maximum value thereof is 20 and an average value thereof is 15. On the other hand, the minimum value of the oblique amount of the group GD2 is 25, a maximum value thereof is 35 and an average value thereof is 30. As a result of this, it is apparent that all of the minimum, the maximum and the average values of the oblique amount of the group GD1 are smaller as compared with those of the group GD2. Thus, it is apparent that the oblique amount is smaller in the case when the oblique roll position is the upstream side, as compared with the case when the oblique roll position is the downstream side, among samples classified into the group GC1.

Accordingly, in the image forming apparatus 1 in the first exemplary embodiment, the tension roll 26 is arranged on the upstream side of the intermediate transfer belt 21 in the rotating direction relative to the driven backup roll 22.

Second Exemplary Embodiment

Figure 7:
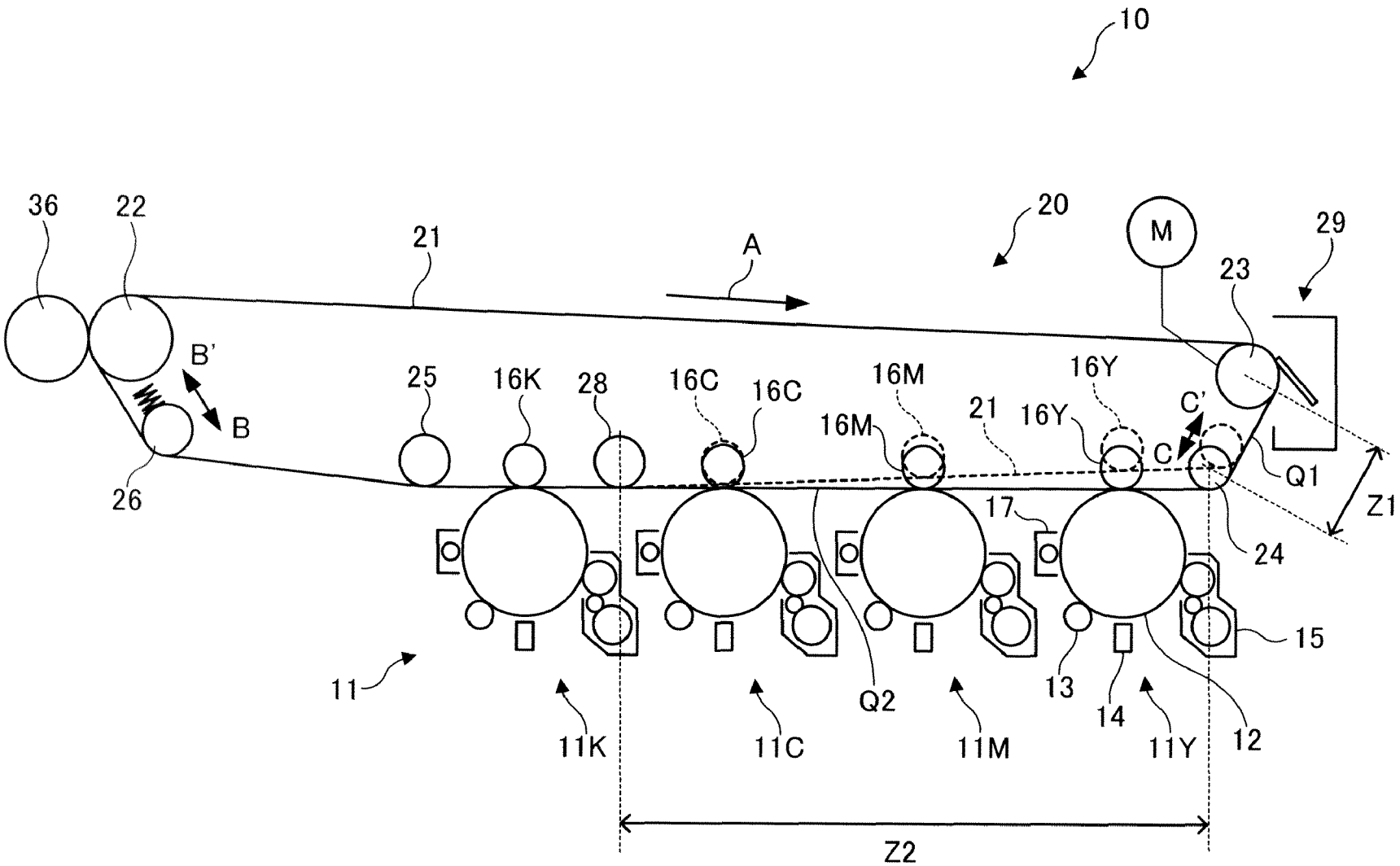
FIG. 7 is a diagram that illustrates an image processing system to which a second exemplary embodiment is applied.

FIG. 7 is a diagram that illustrates the image processing system 10 to which a second exemplary embodiment is applied.

As shown in FIG. 7, a basic configuration of the image processing system 10 to which the second exemplary embodiment is applied is substantially similar to that of the first exemplary embodiment. However, the image processing system 10 to which the second exemplary embodiment is applied differs in comprising a mechanism (a roll or the like) to switch a rotational trajectory of the intermediate transfer belt 21 relative to the respective photosensitive drums 12 between the full-color printing and the monochrome printing.

Note that, with respect to those similar to the image processing system 10 in the first exemplary embodiment, the same reference numerals are assigned and the description is omitted.

In the transfer unit 20 to which the second exemplary embodiment is applied, the intermediate transfer belt 21 is wrapped over the backup roll 22, the cleaner opposed roll 23 that functions as a first roll member and a drive roll, the primary transfer upstream side roll 24 that functions as a second roll member and a trajectory change roll, a holding roll 28 that functions as a third roll member, the primary transfer downstream side roll 25 and the tension roll 26 under a fixed tension (tensile force). Additionally, in the second exemplary embodiment, the driving motor M is connected not to the backup roll 22 but to the cleaner opposed roll 23. The intermediate transfer belt 21 obtains driving force from the cleaner opposed roll 23, and is rotated in an arrow direction A (clockwise) in FIG. 1.

The backup roll 22 is arranged so as to be opposed to the secondary transfer roll 36 similarly to the first exemplary embodiment, and forms the secondary transfer position where the multiple toner images on the intermediate transfer belt 21 is transferred to the sheet P. The cleaner opposed roll 23 is arranged on the downstream side in the rotating direction of the intermediate transfer belt 21 relative to the backup roll 22. In addition, the cleaner opposed roll 23 brings, for example, a blade or the like in contact with the surface of the intermediate transfer belt 21, and is opposed to a belt cleaner 29 that removes the toner or the like remained on the intermediate transfer belt 21, so that the cleaner opposed roll 23 forms a cleaning position of the intermediate transfer belt 21. Note that, as a material of the surface of the cleaner opposed roll 23, rubber or the like having a high coefficient of friction and a predetermined elastic force is used.

The primary transfer upstream side roll 24 is arranged on the downstream side in the rotating direction of the intermediate transfer belt 21 relative to the cleaner opposed roll 23. The holding roll 28 is arranged on the downstream side in the rotating direction of the intermediate transfer belt 21 relative to the primary transfer upstream side roll 24. These primary transfer upstream side roll 24 and the holding roll 28 are arranged so that three primary transfer rolls 16 (16Y, 16M and 16C) of yellow (Y), magenta (M) and cyan (C) provided on the image forming units 11 are put therebetween. In this state, the primary transfer upstream side roll 24 is attached on the upstream side relative to the yellow (Y) primary transfer roll 16Y. The holding roll 28 is attached on the downstream side relative to the cyan (C) primary transfer roll 16C and on the upstream side relative to a black (K) primary transfer roll 16K. Then, primary transfer faces with the image forming units (11Y, 11M and 11C) of yellow (Y), magenta (M) and cyan (C) are formed on the intermediate transfer belt 21 by these primary transfer upstream side roll 24 and holding roll 28.

A moving mechanism (not shown in the figure) is connected to the rotation axis of the primary transfer upstream side roll 24 in the second exemplary embodiment. Accordingly, the primary transfer upstream side roll 24 is arranged to be movable relative to the intermediate transfer belt 21.

The primary transfer downstream side roll 25 is arranged on the downstream side in the rotating direction of the intermediate transfer belt 21 relative to the holding roll 28. In addition, the primary transfer downstream side roll 25 is attached on the upstream side of the black (K) primary transfer roll 16K. Specifically, the holding roll 28 and primary transfer downstream side roll 25 are arranged so that the black (K) primary transfer roll 16K is put therebetween. Consequently, a primary transfer face with the black (K) image forming unit 11K is formed on the intermediate transfer belt 21 by the holding roll 28 and primary transfer downstream side roll 25.

It should be noted that the position of the rotation axes of the backup roll 22, cleaner opposed roll 23, primary transfer downstream side roll 25 and holding roll 28 is relatively fixed to the intermediate transfer belt 21.

Further, on the intermediate transfer belt 21, a first face Q1 is formed by the primary transfer upstream side roll 24 and the cleaner opposed roll 23, and a second face Q2 is formed on the intermediate transfer belt 21 by the primary transfer upstream side roll 24 and the holding roll 28. Furthermore, a first distance Z1 which is a length of the first face Q1 in the rotating direction is set shorter than a second distance Z2 which is a length of the second face Q2 in the rotating direction. The primary transfer upstream side roll 24 is arranged so as to freely slide along the first face Q1 formed on the intermediate transfer belt 21 by a movement mechanism (not shown in the figure).

Next, referring to FIG. 7, switching of the rotational trajectory of the intermediate transfer belt 21 corresponding to the full-color printing and the monochrome printing by the primary transfer upstream side roll 24 will be described.

In the case of full-color printing, in order to make a state where the intermediate transfer belt 21 is brought into contact with the respective photosensitive drums 12 of yellow (Y), magenta (M), cyan (C) and black (K), the primary transfer upstream side roll 24 moves in a direction C leaving from the cleaner opposed roll 23 along the first face Q1, while being subjected to driving force by the movement mechanism (not shown in the figure). Then, the second face Q2 is brought into contact with the respective photosensitive drums 12 of yellow (Y), magenta (M) and cyan (C) as indicated by a solid line in FIG. 7. Thereby, the intermediate transfer belt 21 is rotated on a trajectory including the second face Q2 and indicated by the solid line. Further, at this time, the primary transfer rolls 16 (16Y, 16M and 16C) of yellow (Y), magenta (M) and cyan (C) move to follow the second face Q2, and then they are opposed to the respective photosensitive drums 12 via the intermediate transfer belt 21.

On the other hand, in the case of the monochrome printing, in order to make a state where the intermediate transfer belt 21 is brought into contact with only the photosensitive drum 12 of black (K), the primary transfer upstream side roll 24 moves in a direction C' approaching to the cleaner opposed roll 23 along the first face Q1, while being subjected to the driving force by the movement mechanism (not shown in the figure). Then, the second face Q2 moves in a direction leaving from the respective photosensitive drums 12 of yellow (Y), magenta (M) and cyan (C) by using the holding roll 28 as a fulcrum, as indicated by a broken line in FIG. 7. Thereby, the intermediate transfer belt 21 is rotated on a trajectory including the second face Q2 and indicated by the broken line. Further, the primary transfer rolls 16 (16Y, 16M and 16C) of yellow (Y), magenta (M) and cyan (C) move to follow the second face Q2, and then they are separated from the respective photosensitive drums 12 as indicated by the broken line. At this time, due to the presence of the holding roll 28, a contact state of the intermediate transfer belt 21 and the photosensitive drum 12 of black (K) is maintained.

In this way, in the image forming apparatus 1 to which the second exemplary embodiment is applied, the rotational trajectory of the intermediate transfer belt 21 is switched between the full-color printing and the monochrome printing using the primary transfer upstream side roll 24.

As described above, the primary transfer upstream side roll 24 is a movable roll relative to the intermediate transfer belt 21 similar to the tension roll 26 described in the first exemplary embodiment, and may highly be misaligned following the movement. Therefore, the primary transfer upstream side roll 24 is also arranged so as to satisfy the following conditions based on the findings obtained by the described experiments.

(1) The primary transfer upstream side roll 24 is arranged so as to be moved along a face (the first face Q1 or the second face Q2, and in this example, the first face Q1) formed on the intermediate transfer belt 21 by the primary transfer upstream side roll 24 or the like.

(2) The primary transfer upstream side roll 24 is arranged so as to be moved along the first face Q1 having a shorter length in the rotating direction (Z1<Z2), between the first face Q1 and the second face Q2 formed on the intermediate transfer belt 21 by the primary transfer upstream side roll 24 or the like.

(3) The primary transfer upstream side roll 24 is arranged so as to approach to or leave from the cleaner opposed roll 23 driven by the driving motor M, between the cleaner opposed roll 23 and the holding roll 28 which are arranged to be adjacent to the primary transfer upstream side roll 24.

It may also be interpreted such that, in the second exemplary embodiment, the primary transfer upstream side roll 24 is arranged so as to shorten a distance between the primary transfer upstream side roll 24 and the cleaner opposed roll 23 opposed to the belt cleaner 29. As described above, the cleaner opposed roll 23 is opposed to the belt cleaner 29 to form the cleaning position. In this cleaning position, the belt cleaner 29 presses the intermediate transfer belt 21 against the cleaner opposed roll 23. This causes frictional force between the cleaner opposed roll 23 and the intermediate transfer belt 21 to be made larger as compared with that of other rolls. That is, the intermediate transfer belt 21 in the cleaning position is hardly deviated in a direction orthogonal to the transportation direction as compared with a contact position to the holding roll 28. Accordingly, if the primary transfer upstream side roll 24 is misaligned and force is generated so as to make the intermediate transfer belt 21 oblique, the cleaner opposed roll 23 which is adjacently arranged to the primary transfer upstream side roll 24, and the belt cleaner 29 apply force pressing against the intermediate transfer belt 21. As a result of this, the obliqueness of the intermediate transfer belt 21 is further suppressed.

It may also be interpreted such that, in the first exemplary embodiment, the tension roll 26 is arranged so as to shorten a distance between the tension roll 26 and the backup roll 22 opposed to the secondary transfer roll 36. The backup roll 22 is opposed to the secondary transfer roll 36 to form the secondary transfer position. In this secondary transfer position, the secondary transfer roll 36 presses the intermediate transfer belt 21 against the backup roll 22. This causes frictional force between the backup roll 22 and the intermediate transfer belt 21 to be made larger as compared with that between the primary transfer downstream side roll 25 and the intermediate transfer belt 21. That is, the intermediate transfer belt 21 in the secondary transfer position is hardly deviated in a direction orthogonal to the transportation direction as compared with a contact position to the primary transfer downstream side roll 25. Accordingly, if the tension roll 26 is misaligned and force is generated so as to make the intermediate transfer belt 21 oblique, the backup roll 22 which is adjacently arranged to the tension roll 26, and the secondary transfer roll 36 apply force pressing against the intermediate transfer belt 21. As a result of this, the obliqueness of the intermediate transfer belt 21 is further suppressed.

It should be noted that the above-described configuration concerning an attachment position of the above-described movable roll and the setting of its direction of movement is not limited to the intermediate transfer belt exemplified in the exemplary embodiments. For example, even if a photosensitive belt, a sheet transportation belt or the like is employed, the obliqueness of belts may be suppressed by applying the above-described configuration.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A belt transporting apparatus comprising:

a belt member that is rotated;

a first roll member that holds the belt member;

a second roll member that is provided apart from the first roll member by a first distance, holds the belt member together with the first roll member and is movable toward the first roll member; and a third roll member that is provided apart from the second roll member by a second distance and holds the belt member together with the second roll member, the second distance being longer than the first distance, wherein the first roll member is a drive roll that rotatable drives the belt member.

2. The belt transporting apparatus according to claim 1, wherein the second roll member is arranged on an upstream side in a rotating direction of the belt member relative to the first roll member.

3. The belt transporting apparatus according to claim 1, wherein the second roll member is a tension-adjusting roll that adjusts tension applied to the belt member.

4. The belt transporting apparatus according to claim 1, further comprising a cleaning member that is arranged to be brought in contact with the belt member at a position opposed to the first roll member while the belt member is sandwiched therebetween, and removes adhesion material on the belt member.

5. An image forming apparatus comprising:

a plurality of image forming units;

an intermediate transfer belt that holds and transports images formed by the plurality of image forming units;

a first roll member that holds the intermediate transfer belt;

a second roll member that holds the intermediate transfer belt together with the first roll member, forms a first face on the intermediate transfer belt between the first roll member and the second roll member, and is movable along the first face; and a third roll member that forms a second face on the intermediate transfer belt together with the second roll member, the second face having a longer distance in a rotating direction of the intermediate transfer belt than the first face, wherein the plurality of image forming units respectively include:

an image carrier that the image is formed thereon; and a primary transfer member that transfers the image formed on the image carrier to the intermediate transfer belt, and the second roll member is a path change roll that changes the number of the image carriers being in contact with the intermediate transfer belt by changing a rotation path of the intermediate transfer belt.

6. A belt member transporting method for use in an image forming apparatus, the belt member transporting method comprising:

rotating a belt member by driving a first roll member in a state where the belt member is held by the first roll member, a second roll member that is provided apart from the first roll member by a first distance and is movable toward the first roll member, and a third roll member that is provided apart from the second roll member by a second distance longer than the first distance; and adjusting tensile force of the belt member by moving the second roll member toward the first roll member, wherein the first roll member is a drive roll that rotatable drives the belt member.

7. The belt member transporting method according to claim 6, wherein the second roll member is arranged on an upstream side in a rotating direction of the belt member relative to the first roll member.

8. The belt member transporting method according to claim 6, wherein the second roll member is a tension-adjusting roll that adjusts tension applied to the belt member.

* * * * *